US006990689B1

(12) United States Patent
Thellmann

(10) Patent No.: US 6,990,689 B1
(45) Date of Patent: Jan. 31, 2006

(54) WEIGHTED SOCCER GOALIE GLOVE

(76) Inventor: Dieter Thellmann, 693 Stag Pl., Gahanna, OH (US) 43230

( * ) Notice: Subject to any disclaimer, the term of this patent is extended or adjusted under 35 U.S.C. 154(b) by 0 days.

(21) Appl. No.: 10/631,700

(22) Filed: Jul. 31, 2003

(51) Int. Cl.
*A41D 19/00* (2006.01)

(52) U.S. Cl. ..... 2/161.1

(58) Field of Classification Search ..... 2/16, 2/20, 158, 159, 160, 161.1, 161.2, 161.3, 2/161.4, 161.6, 162, 163; 482/105
See application file for complete search history.

(56) References Cited

U.S. PATENT DOCUMENTS

| | | | | | |
|---|---|---|---|---|---|
| 4,247,097 | A | | 1/1981 | Schwartz | |
| 4,326,706 | A | * | 4/1982 | Guthrie et al. | 482/105 |
| 4,330,120 | A | * | 5/1982 | Netti | 482/105 |
| 4,371,983 | A | | 2/1983 | Piotti, Jr. | |
| 4,575,075 | A | | 3/1986 | Tarbox et al. | |
| 4,704,743 | A | * | 11/1987 | Thornell et al. | 2/161.1 |
| 4,751,749 | A | | 6/1988 | Cowhey | |
| 4,813,079 | A | | 3/1989 | Reitzel | |
| 4,911,433 | A | | 3/1990 | Walker et al. | |
| 5,004,231 | A | | 4/1991 | Alread | |
| 5,448,777 | A | | 9/1995 | Lew | |
| 5,468,200 | A | | 11/1995 | Hoffman | |
| 5,500,956 | A | * | 3/1996 | Schulkin et al. | 2/161.1 |
| 5,530,967 | A | | 7/1996 | Cielo | |
| 5,704,883 | A | | 1/1998 | Eckmann | |
| 5,768,710 | A | | 6/1998 | Williams | |
| 5,802,615 | A | | 9/1998 | Wenk | |
| 5,970,521 | A | * | 10/1999 | Rabbeth | 2/161.1 |
| 5,987,646 | A | * | 11/1999 | Bolmer | 2/161.1 |
| 6,049,910 | A | | 4/2000 | McCarter | |
| 6,119,271 | A | | 9/2000 | Byon | |
| 6,154,885 | A | * | 12/2000 | Kobayashi et al. | 2/161.3 |
| 6,279,163 | B1 | | 8/2001 | Hale et al. | |
| 6,543,057 | B2 | * | 4/2003 | Beland et al. | 2/161.1 |
| 6,553,574 | B1 | | 4/2003 | Hall, Jr. et al. | |
| 6,557,177 | B2 | * | 5/2003 | Hochmuth | 2/159 |
| 6,772,441 | B2 | * | 8/2004 | Lucas, Jr. | 2/161.1 |
| 2002/0128120 | A1 | | 9/2002 | Cook | |
| 2002/0128126 | A1 | | 9/2002 | Cook | |

* cited by examiner

*Primary Examiner*—Gary L. Welch
(74) *Attorney, Agent, or Firm*—Eschweiler & Associates, LLC

(57) ABSTRACT

The present invention pertains to a weighted sports glove that improves the strength, quickness and agility of a soccer goalie. More particularly, the present invention pertains to a soccer goalie glove where one or more weights can be selectively added to and/or removed from the glove during training, and the same glove can subsequently be worn during competition. The glove includes one or more pockets that can selectively receive different weights for use in different training sessions and/or by goalies that have different skill levels or relative strengths and/or are different sizes or ages. The glove also has a layer of material along its palm-side to help in gripping a soccer ball, as well as rigid members in finger portions to mitigate hyper-extending digits. The one or more weights are located within the glove for optimal biomechanical advantage. In particular, the weights are located on a back portion of the hand to facilitate resistive training to strengthen desired body parts (e.g., shoulders, forearms, wrists, upper arms). The location of the weights thus enhances responsiveness, dexterity and hand eye coordination, while improving stamina of the muscles controlling movement of the hand, particularly when the weighted glove is worn during practice and the goalie repeatedly goes through particular training movements.

19 Claims, 3 Drawing Sheets

WEIGHTED SOCCER GOALIE GLOVE

FIELD OF INVENTION

The present invention relates generally to the field of sporting gloves, and more particularly to a soccer goalie glove that can be selectively weighted and used by a soccer goalie during training and leading to actual competition.

BACKGROUND OF THE INVENTION

The difference between a World Cup victory and a very unpopular soccer goalie can be a matter of inches or less, and can be determined in a fraction of a second. Accordingly, an implement that would facilitate faster reaction time and/or allow a soccer goalie to cover more area in a shorter period of time would be desirable.

In many types of sports, including soccer, an effort to improve performance is made via athletic training. Such training generally includes some type of physical conditioning, where the physical conditioning often comprises weight training to improve, among other things, muscular strength. Weight training, however, is generally performed at a time and place separate and apart from where a soccer goalie might practice his or her goal tending skills. Thus, weight training usually requires training time in addition to that utilized to work on goal tending skills. It may also entail additional travel time for commuting to and from one or more separate weight training facilities. For modern families that have one or more members (e.g., children) playing soccer, this can put a significant strain on already hectic schedules.

Additionally, weight training is often performed on free weights and/or weight machines where general muscle areas or groups are trained. Thus, weight training may not work particular muscles that a soccer goalie needs to strengthen to enhance his or her performance. For example, while a bench press or squat may improve a goalie's overall upper or lower body strength, respectively, it may not assist with strengthening a particular body part, such as the goalie's hands or wrist, for example, which can play a subtle, but important part in a goalie's overall effectiveness.

Also, weight training may not help "soften" a goalie's hands or improve his or her sense of timing and/or touch. To date, one of the mechanisms that has come of age that may strengthen and soften a soccer goalie's hands while allowing the goalie to work on his or her goal tending skills, albeit to a limited degree, is a medicine ball. A medicine ball is a heavy ball that resembles a soccer ball. Medicine balls that may be used in association with soccer training may weigh several (e.g., around five) pounds and can be repeatedly served to a goalie for practice. This may, however, require one or more other individuals (e.g., trainers) to serve the medicine ball to the goalie, which can add expense and additional logistic coordination to the training process. Additionally, since the ball is heavy, the trainer may quickly tire-out limiting practice time.

A goalie can, however, repeatedly throw a medicine ball up into the air and catch it his-self or her-self to soften and strengthen his or her hands, but this does not necessarily help in developing the goalie's goal tending skills. For instance, it may not provide any training with regard to reaction time. It may not assist with getting a goalie's hands up and over from point to point as quickly as possible. It may also do very little to improve a goalie's range or reach for blocking shots.

Since the difference between an average goal keeper and a great goal keeper can be a matter of inches or less, a mechanism that would concurrently facilitate muscle strengthening while allowing a soccer goalie to work on his or her goal tending skills and improve his or her range would be desirable.

SUMMARY OF THE INVENTION

The following presents a simplified summary of the invention in order to provide a basic understanding of some aspects of the invention. This summary is not an extensive overview of the invention. It is intended neither to identify key or critical elements of the invention nor to delineate the scope of the invention. Rather, its primary purpose is merely to present one or more concepts of the invention in a simplified form as a prelude to the more detailed description that is presented later.

The present invention pertains to a weighted sports glove that improves the strength, quickness and agility of a soccer goalie. More particularly, the present invention pertains to a soccer goalie glove where weights can be selectively added to and/or removed from the glove during training, and the same glove can subsequently be worn during competition. Utilizing the same gloves for practice and play facilitates improved performance by, among other things, bolstering a goalie's confidence as he or she possesses a great deal of familiarity and comfort with the gloves. More particularly, the gloves are broken in and conform to the particular nuances of the goalie's hands giving the goalie a good sense of feel with the gloves.

According to one aspect of the present invention, a soccer goalie glove is disclosed that is suitable for use during training in a weighted condition and during play in an un-weighted condition. The glove facilitates improvement in the strength, agility and quickness of a goalie training with the glove, and is capable of being worn on either of the goalie's hands. The glove has a palm side and a back side, as well as means for selectively attaching a weight to the backside of the glove opposite a palm portion of the glove. The glove further includes a thin layer of material along the palm side of the glove to facilitate gripping a soccer ball. Relative to materials out of which other parts of the glove are fashioned, the thin layer of material has an increased coefficient of friction for leather or other materials out of which soccer balls may be made.

In accordance with one or more other aspects of the present invention, a soccer goalie training glove that is also suitable for use during actual competition is disclosed. The glove has a palm side, a back side and a pocket formed within the backside opposite a palm portion of the glove. A weight is included that can be selectively received within and removed from the pocket. A fastener is also included that assists with maintaining the weight within the pocket. A thin layer of material exists along the palm side of the glove to facilitate gripping a soccer ball. The thin layer of material has an increased coefficient of friction for leather or other materials out of which soccer balls are made relative to materials out of which other parts of the glove are fashioned.

According to one or more other aspects of the present invention, a soccer goalie glove that is suitable for use during training in a weighted condition and during play in an un-weighted condition is disclosed. The glove facilitates improvement in the strength, agility and quickness of a goalie training with the glove and is capable of being worn on either of the goalie's hands. The glove has a palm side and a back side and includes a pocket formed within the backside of the glove opposite a palm portion of the glove. The pocket is configured to selectively receive a weight. The glove also includes securing means for securing the weight within the pocket and closing means for closing the pocket. A rigid aspect is further located in a backside of a finger portion of the glove to mitigate digit hyperextension. A thin layer of material also extends all along the palm side of the glove, including under a wrist and a finger portion of the glove. Relative to materials out of which other parts of the glove are made, the thin layer of material has an increased coefficient of friction for leather or other like materials out of which soccer balls may be made to facilitate enhanced gripping of a soccer ball. A wrist strap is included on the glove to assist in securing the glove to a goalie's hand. The wrist strap does not create a discontinuity in the thin layer of material.

To the accomplishment of the foregoing and related ends, the following description and annexed drawings set forth in detail certain illustrative aspects and implementations of the invention. These are indicative of but a few of the various ways in which one or more aspects of the present invention may be employed. Other aspects, advantages and novel features of the invention will become apparent from the following detailed description of the invention when considered in conjunction with the annexed drawings.

DETAILED DESCRIPTION OF THE INVENTION

Figure 1:
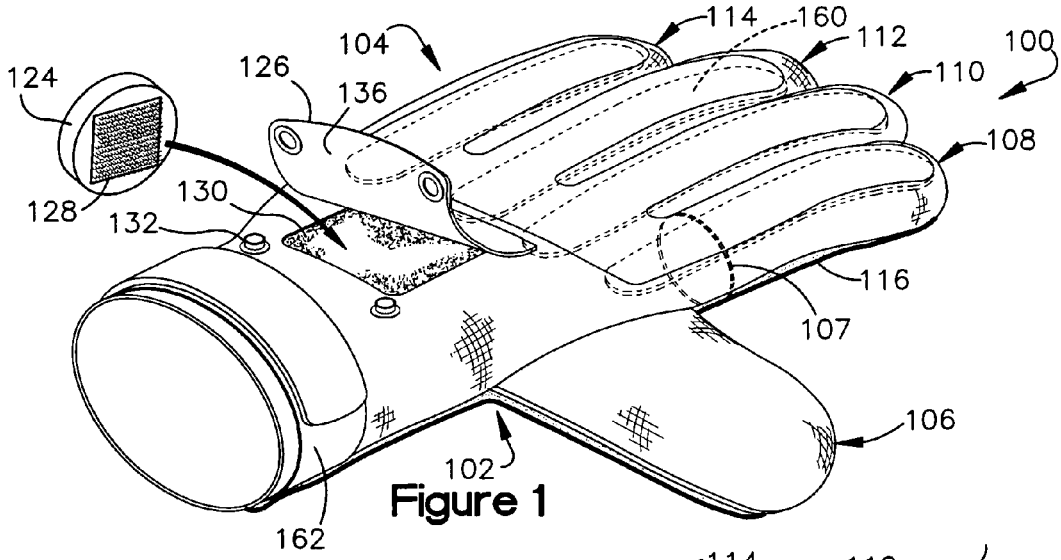
FIG. 1 is a perspective view of an exemplary soccer goalie glove in accordance with one or more aspects of the present invention illustrating an arrangement for inserting a weight within a pocket formed within a back-side of the glove.

One or more aspects of the present invention are described with reference to the drawings, wherein like reference numerals are generally utilized to refer to like elements throughout, and wherein the various structures and/or features are not necessarily drawn to scale. In the following description, for purposes of explanation, numerous specific details are set forth in order to provide a thorough understanding of one or more aspects of the present invention. It may be evident, however, to one skilled in the art that one or more aspects of the present invention may be practiced with a lesser degree of these specific details. In other instances, well-known structures and devices may be shown in block diagram form in order to facilitate describing one or more aspects of the present invention.

The present invention pertains to a soccer goalie glove where weights can be selectively added to and/or removed from the glove during training, and the same glove can subsequently be worn during competition. Utilizing the same gloves for practice and play facilitates improved performance by, among other things, bolstering a goalie's confidence as he or she possesses a great deal of familiarity and comfort with the gloves. More particularly, the gloves are broken in and conform to the particular nuances of the goalie's hands giving the goalie a good sense of feel with the gloves.

One or more weights are located within the glove for optimal biomechanical advantage. In particular, the weight (s) are located on a back portion of the hand to facilitate resistive training to strengthen desired body parts (e.g., shoulders, forearms, wrists, upper arms). The location of the weight(s) thus enhances responsiveness, dexterity and hand eye coordination, while improving stamina of the muscles controlling movement of the hand, particularly when the weighted glove is worn during practice and the goalie repeatedly goes through particular training motions.

With reference to the attached Figures, the glove 100 has a palm 102 and a backside 104, and includes a plurality of finger portions. In the illustrated example, the glove includes five finger portions 106, 108, 110, 112, 114—one for the thumb and each of the four fingers. It will be appreciated, however, that the glove can contain any suitable number of finger portions depending upon the needs and preferences of the goalie. Additionally, the finger portions may also be designed so as to not completely encase one or more of the goalie's fingers. For example, the goalie may desire to have at least a portion of one or more of his or her digits at least partially exposed to enhance tactile sensitivity and/or keep his or her hands cool, among other things.

Further, although not explicitly shown, it is contemplated that one or more of the finger portions 106,108, 110,112,114 may also be selectively detachable and re-attachable as may suit the needs and desires of the goalie. The finger portions 106 may, for example, be attached with any suitable type(s) of fastening means 107 (illustrated in phantom in FIG. 1), such as buttons, snaps, zippers, tape and/or a hook and latch/loop type system, for example. In a hook and latch system, a plurality of hooks engage a plurality of loops when the two are brought together. It will be appreciated that an exemplary hook and loop system is commonly known as VELCRO.

The glove 100 is formed out of one or more suitable materials, such as latex, neoprene, vinyl, nylon, one or more elastomers, woven fabrics, real and/or artificial leathers, etc., for example. The materials can overlay one another and/or be arranged in any suitable manner (e.g., stitched together) to achieve a desired configuration, interrelation and/or cooperation. By way of example, one or more portions of the assembled materials can have a thickness of about three millimeters, for example, so as to yield a desired balance of weight, flexibility, elasticity, stiffness, resiliency, durability and/or breath-ability, for example.

The materials also instill the glove with a sufficient level of cushioning and/or softness for absorbing some of the impact and/or shock associated with blocking a shot and/or diving for a ball. For example, the underside or palm portion 102 of the glove 100 may include a thin foam-like material 116 that is somewhat compressible so as to absorb some of the energy of an incoming shot, as well as some of the impact of the goalie's body weight should the goalie dive for a ball and land on his or her hands. In this manner, the glove affords the goalie with a certain degree of protection. Similarly, the materials may be rigid enough to protect the goalie's hand from contact with other players. For example, the glove may be durable enough to prevent injury should another player step on the goalie's hand (e.g., with sharp cleats) and/or otherwise come into contact with the goalie while attempting to kick a goal.

The underlying layer of foam-like material 116 may also have a slightly higher coefficient of friction than the rest of the materials comprising the glove body. By way of example, such a layer 116 may have a coefficient of friction between about 0.5 and 1.5 as measured against leather or other similar materials out of which soccer balls are generally made. This provides the glove 100 with a certain degree of "stickiness" or "tackiness" that may, for example, assist with catching or blocking a soccer ball, as well as with exercising a greater degree of control over passing or in-bounding the ball.

Figure 3:
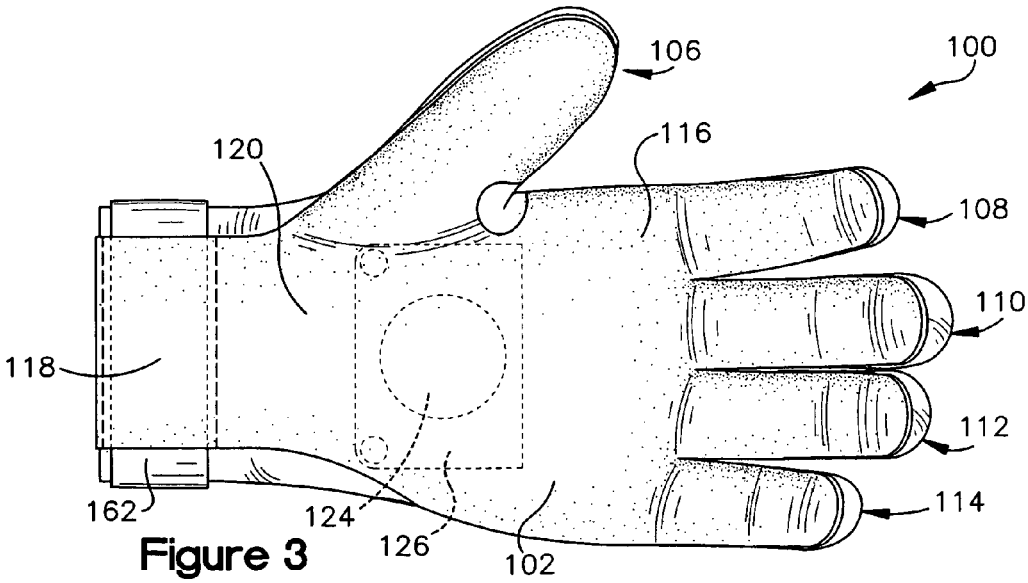
FIG. 3 is a bottom view of another exemplary soccer goalie glove in accordance with one or more aspects of the present invention illustrating a layer of material formed across a palm-side of the glove that facilitates enhanced gripping of a soccer ball.
Figure 4:
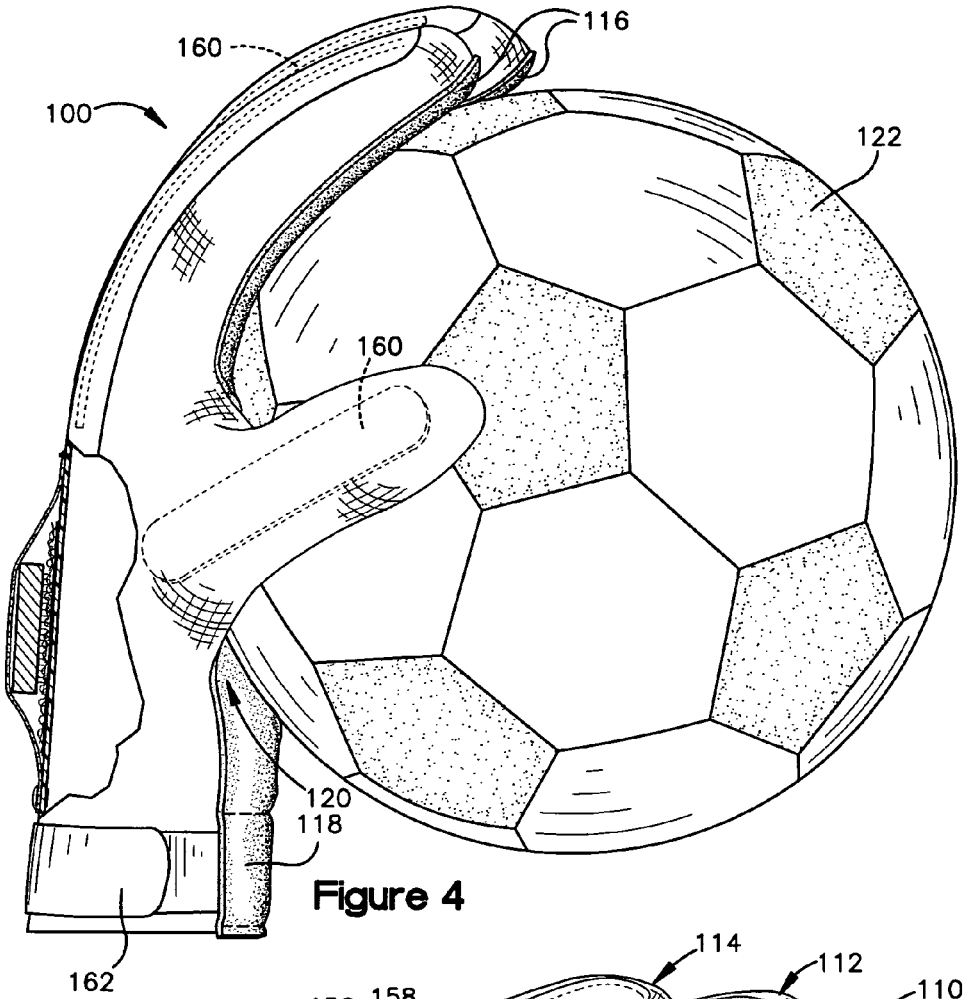
FIG. 4 is a side view of another exemplary soccer goalie glove in accordance with one or more aspects of the present invention illustrating the ability to "palm" a soccer ball with the glove.

This layer of thin foam-like material 116 may extend throughout the entirety of the palm side of the glove, including under the finger portions 106, 108,110,112,114 of the glove as well as under a wrist 118 and palm 120 portion of the glove 100 (FIG. 3). This allows a goalie to "palm" a soccer ball in a desirable manner (FIG. 4). In particular, the ball gets pinched or is frictionally adhered between the finger portions 106,108,110, 112, 114 of the glove and the palm 120 and wrist 118 portions of the glove 100 when the goalie cups his or her hand around the ball 122. Such a capability is desirable since a goalie commonly gestures with one hand to communicate directions or instructions to his or her teammates, while holding onto/palming the ball with his or her other hand. Additionally, a goalie also frequently puts a blocked or caught ball back into play by relaying it to his or her teammates in a "bowling" fashion or "whipping" it to them via an overhand motion. The adherence of the ball between the wrist and finger portions of the glove allows the goalie to "bowl" or "whip" the ball to his or her teammates with a greater degree of control, accuracy and precision.

The glove 100 also includes means for selectively accommodating a weight 124. The weight 124 can be selectively added to and removed from the glove as desired for, among other things, training and strengthening purposes. The glove 100 may include a pocket or flap 126 to facilitate selective accommodation of the weight 124. Preferably, the shape and size of the pocket 126 is generally similar to the dimensional characteristics of the weight 124. In the example shown, the weight 124 comprises a generally disk shaped member that can rest against the back of the hand, and the pocket 126 is generally square or rectangular to accommodate the weight 124.

Preferably, the weight 124 is associated within the pocket 126 in a substantially fixed relationship so as to not move around when the goalie makes quick or sudden movements. This prevents the weight 124 from becoming a nuisance and potentially impacting or bouncing against the back of the hand. In the illustrated example, to secure the weight in the glove 100, one side of the weight 124 has a pad 128 of Velcro hooks or loops adhered (e.g., glued) thereto, and the backside of the glove 100 has a corresponding pad 130 of Velcro loops or hooks affixed (e.g., stitched) thereto (FIG. 1). The weight 124 is thus held in place when the corresponding Velcro pads 128,130 are brought together.

Figure 2:
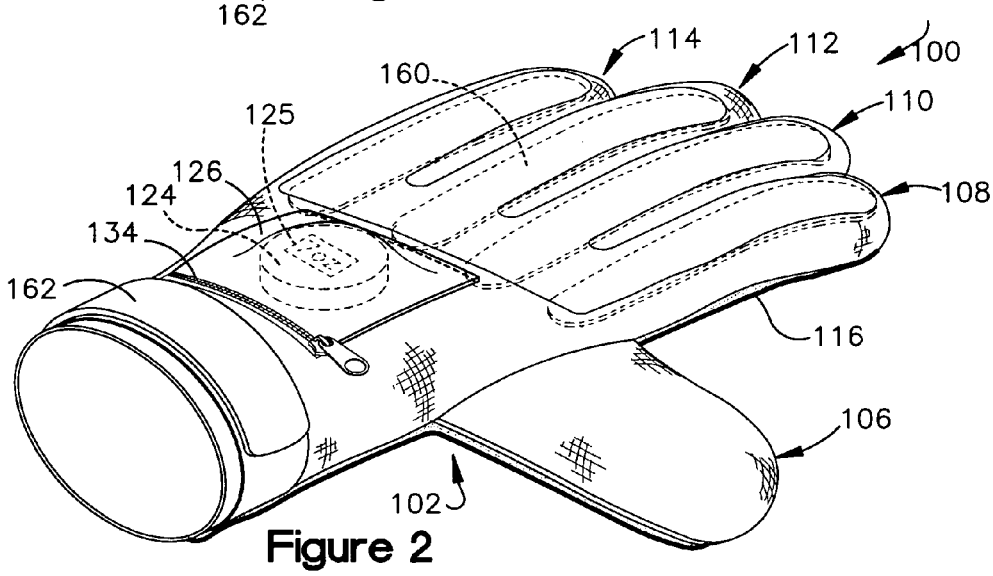
FIG. 2 is a perspective view of another exemplary soccer goalie glove in accordance with one or more aspects of the present invention illustrating an arrangement wherein a weight is sealed within a pocket in a back-side of the glove via a zipper.
Figure 6:
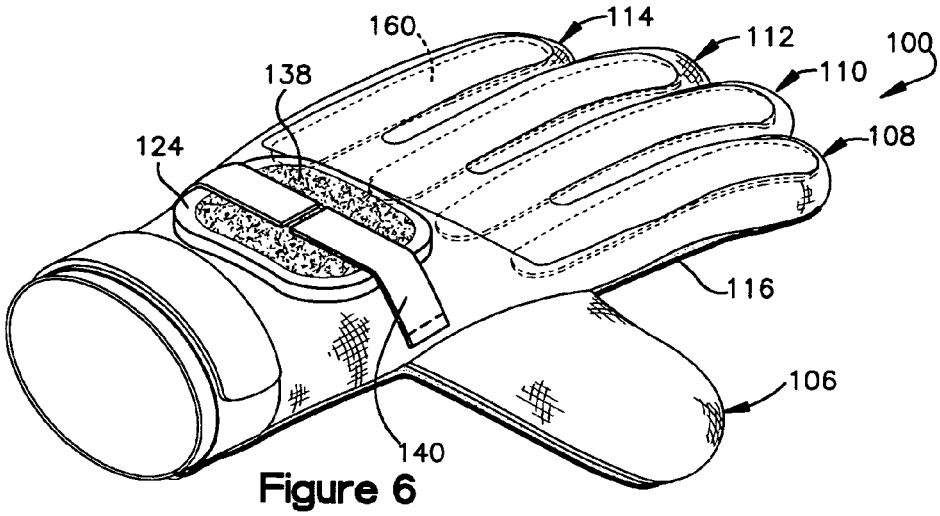
FIG. 6 is a perspective view of another exemplary soccer goalie glove in accordance with one or more aspects of the present invention illustrating an alternative arrangement for attaching a weight to a back-side of the glove where Velcro straps attach to a Velcro pad affixed to the weight.

Additionally, the pocket or flap 126 may be outfitted with closing means to seal the weight 124 therein. In the illustrated example(s), the pocket 126 is equipped with snaps 132 (FIG. 1) as well as a zipper 134 (FIG. 2). It will be appreciated, however, that any suitable type of closing means can be utilized, such as buttons, tape, Velcro pads, etc. Similarly, any suitable type of securing means can be utilized to hold the weight in place, such as buttons, tape, snaps, etc. By way of example, although not shown, the weight 124 depicted in FIG. 1 may also have a Velcro pad affixed to its top side. This pad could engage a Velcro pad affixed to the underside 136 of the flap 126 (also not shown) to assist with securely fastening the weight 124 within the glove 100. FIG. 6 illustrates a situation where the weight 124 includes a Velcro pad 138 affixed to its top side. The weight is held in place by one or more (e.g., two) Velcro straps 140 that engage this pad 138, and that are fixedly secured (e.g., stitched) to the back-side of the glove 100.

It will be appreciated that some of the material for securing the weight 124 within the pocket 126 (e.g., one or more VELCRO pads) may provide additional cushioning between the back of the hand and the weight 124. It will be further appreciated that other shock-absorbing materials, such as one or more layers of rubber or other elastomeric materials, could also be provided within the pocket 126 to provide further cushioning. Additionally, the weight itself may be encased within a rubber coating or other like material that provides further cushioning between the weight 124 and the back of the hand. Such a coating may also serve to protect the weight from damage, such as chipping, cracking, etc. Also, the weight may include indicia 125 (FIG. 2) designating, among other things, the magnitude of the weight, and such a rubber-like coating may provide a convenient medium for embedding such indicia.

It will be appreciated that the weight 124 can be formed out of any suitable material and have any desired shape. The weight 124 can, for example, be formed out of steel, which doesn't break down or rust and keeps its shape. Similarly, the weight 124 can be made out of iron, copper, lead, silicon, ceramics, magnetic materials, etc. Such materials hold their shape and can be fashioned into any desirable shape with relative ease. For example, the weight can be formed into an oval shape that lacks sharp edges, or a shape that mimics the contours of the back of the hand. A weight formed out of magnetic materials may provide therapeutic effects to relieve symptoms associated with arthritis, fatigue, neuralgia, myalgia and/or phlegm, etc.

Further, the weight 124 may comprise a body of material that is somewhat malleable and/or can flow to a certain degree to conform to the back of the hand. For example, the weight 124 can be formed out of a sack of sand, metal shot or the like which readily conforms to the contours of the hand. This may serve to keep the weight in place while distributing its mass about a greater surface area to provide added comfort to the goalie.

The location of the weight 124 within the glove 100 is chosen for optimal biomechanical advantage. More particularly, the weight 124 is located on a back portion of the hand to facilitate resistive training to strengthen desired body parts (e.g., shoulders, forearms, wrists, upper arms). The location of the weights thus enhances responsiveness, dexterity and hand eye coordination, while improving stamina of the muscles controlling movement of the hand, particularly when the weighted glove is worn during practice and the goalie repeatedly goes through particular training movements.

Figure 5:
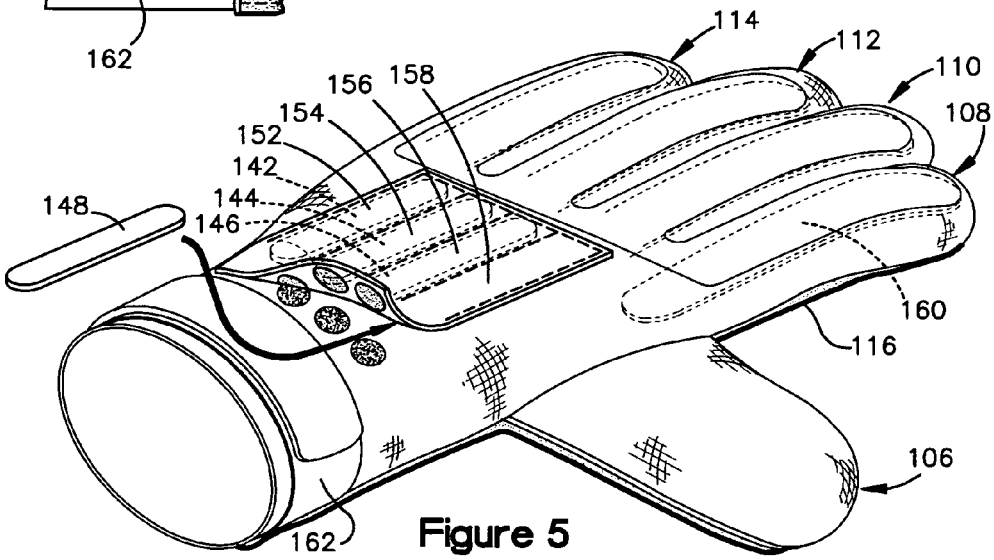
FIG. 5 is a perspective view of another exemplary soccer goalie glove in accordance with one or more aspects of the present invention illustrating an arrangement adapted to receive a plurality of weights within corresponding pockets formed within a back-side of the glove.

It will be appreciated that multiple weights can be utilized in accordance with aspects of the present invention (FIG. 5). For example, a plurality of weights having the same or different magnitudes can be selectively associated with the glove 100 to provide a desired training weight. In the illustrated example, four substantially rectangular shaped weights 142, 144, 146, 148 are situated within respective pouches 152,154, 156,158 so as to be substantially parallel to metacarpal bones in the back of the hand. Such pouches 152,154, 156,158 can snugly receive the weights 142,144, 146, 148 and/or the weights 142, 144, 146, 148 can be selectively secured therein via securing means (e.g., Velcro pads, buttons, snaps, etc.). Such weights may similarly be selectively added to one larger pocket that can be opened and closed. It will be appreciated that while the weights can be arranged in any suitable manner, the illustrated configuration of the weights being parallel to the metacarpal bones allows for comfortable flexing of the hand and mitigates interference with finger, hand and/or wrist movements.

The glove also includes a mechanism for mitigating hyper-extending one or more digits (e.g., when a soccer ball or other player comes into contact with the goalie). In the illustrated example, respective stabilizing members or components 160 are included in each of the five finger portions 106,108,110, 112, 114 to allow the fingers to bend forward, but backward to only a limited degree. These stabilizing members 160 may, for example, be stitched within a backside or otherwise formed within or affixed to the finger portions 106, 108, 110,112,114. The members 160 are formed out of a somewhat rigid, yet resilient, material that allows the fingers to readily flex forward, while limiting the fingers' backward movement. The members 160 may, for example, be formed out of metal and/or plastic materials and, although not shown, can have striations or other stress relief points formed therein to facilitate the substantially one-way (e.g., forward) bending and flexing capability. Since the members 160 can readily flex forward, they do not adversely impact contracting movements, and thus allow a goalie to make a fist and/or palm a soccer ball (FIG. 4), for example. The members 160 may also be designed with a slight curvature so that the glove 100 has a configuration that mirrors a human hand at rest, making the glove 100 more comfortable and less tiring for a goalie to wear.

A wrist strap 162 is also included on the glove 100 to assist with maintaining the glove 100 on the goalie's hand. The wrist strap 162 can, for example, include corresponding Velcro hook and loop sections that engage one another when the strap 162 is drawn taughtly around the goalie's wrist. It will be appreciated, however, that the wrist strap 162 can include any suitable means for securing the glove 100 in place (e.g., snaps, buttons, etc.). It will be further appreciated that the wrist strap 162 is designed so as to not interfere with the goalie's ability to palm or hold onto a soccer ball, which is at least partially facilitated by the wrist portion 118 of the foam layer 116 (FIG. 4). Accordingly, the wrist strap 162 may, for example, loop or thread under the wrist portion 118 of the foam layer 116 (FIG. 3). Alternatively, or in addition, the wrist strap 164, or a portion thereof, may include a substance that helps grip a soccer ball. For example, the strap may possess an over-layer of the thin foam material, particularly where the strap 162 wraps around the underside of the wrist.

It will be appreciated that while a left handed glove is illustrated herein, the present invention contemplates a right handed glove as well, where the right handed glove is, of course, a mirror image of the left. It will be further appreciated that a user can wear the gloves during a training session with the same, different or no weights within each of the gloves. Practicing with different weights in the respective gloves may facilitate improving/strengthening a non-dominant side of the body, for example. Differently weighted gloves can also serve rehabilitative purposes (e.g., on a recently repaired shoulder that may have been weakened due to an injury).

Accordingly, one or more aspects of the present invention allow a goalie to train with weighted gloves and then play with the same gloves in an un-weighted condition. During practice a goalie can utilize desired weights and change the amount of weight as he or she progresses and/or moves from one training routine to another. A goalie can, for example, begin training with two ounce weights and work up to six ounce weights. It will be appreciated, however, that any suitable magnitude of weights is contemplated herein.

By training in such a fashion, the speed of translation from the goalie's hands to eyes to brain and then back to his or her hands is enhanced. This allows a goalie to react much quicker. For example, a goalie can achieve a particular blocking state quicker and then have the time to make adjustments in case an incoming ball curves, bends in or is a knuckle ball, etc.

Figure 7:
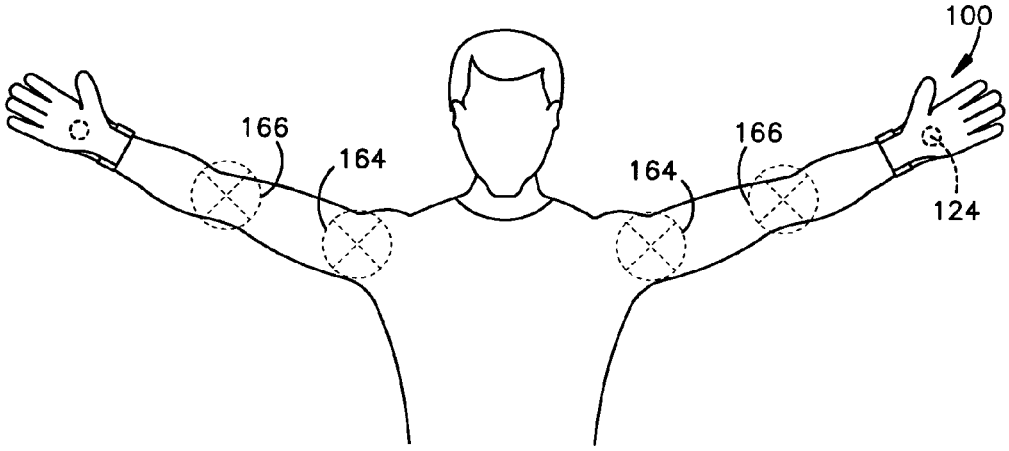
FIGS. 7 and 8 distinguish joints that are strengthened, lengthened or otherwise positively affected by using gloves according to one or more aspects of the present invention.
Figure 8:
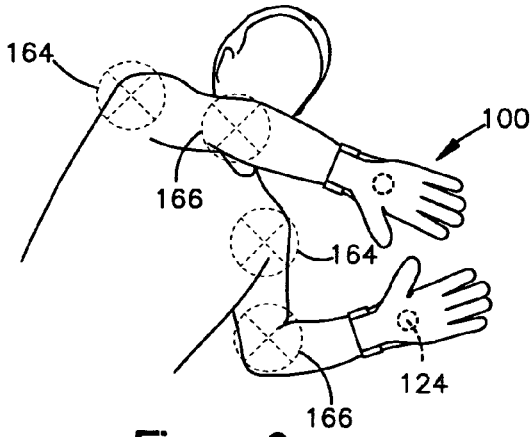

Such training also facilitates improved flexibility and enhances a goalie's range. In particular, the mass and corresponding momentum of the goalie's hands is increased by the weighted gloves 100. This causes a goalie's joints, such as shoulder 164 and elbow 166 joints (FIGS. 7 and 8) to spread-out and loosen when a goalie goes to block a shot. The weighted gloves 100 also strengthen vulnerable areas, such as shoulder sockets. Goal keepers can commonly pop out their shoulders when diving, particularly if they don't dive properly.

Training with the weighted gloves also builds confidence in a goal keeper because it enhances the goalie's beliefs in his or her abilities. After training with weighted gloves, the goalie's hands feel significantly lighter when he or she uses the gloves without the weights. The goalie's hand speed feels dramatically increased, and his or her "targeted" muscles are actually much stronger after training with the weighted gloves. The goalie's mental perception of his or her improved quickness and explosiveness translates into improved physical performance, ability and agility. The goalies improved confidence and belief that he or she can get to a location quicker also helps the goalie to play more relaxed, which in turn further improves the goalie's performance.

Training with weighted gloves becomes an integral part of a whole training concept. The goalie becomes more agile and has increased strength where it counts, and thus plays looser. By repetitively performing predetermined training movements designed to target and exercise specific muscles or groups of muscles, the goalie's hand and arm strength and dexterity is significantly improved. This may also allow a goalie to feel as if he or she has to dive less often. Diving is a last resort to make a save, because once a goalie is off of his or her feet recovery time may be too long for the goalie to get back up and re-set. If a goalie can remain on his or her feet for a longer period of time, then he or she is going to have a much better chance of making a save. Additionally, a goalie is much more vulnerable to injuries when diving.

In accordance with one or more other aspects of the present invention, a kit is also provided for increasing hand and arm strength, while concurrently allowing a soccer goalie to work on his or her goal tending skills. The kit includes at least one soccer goalie glove made in accordance with that which is disclosed herein and at least one weight for insertion into a pocket of the glove.

Although the invention has been shown and described with respect to one or more implementations, equivalent alterations and modifications will occur to others skilled in the art based upon a reading and understanding of this specification and the annexed drawings. The invention includes all such modifications and alterations and is limited only by the scope of the following claims. In particular regard to the various functions performed by the above described components (assemblies, devices, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. A soccer goalie glove suitable for use during training in a weighted condition and during play in an un-weighted condition, the glove facilitating improvement in the strength, agility and quickness of a goalie training with the glove, the glove comprising:

a palm side;

a back side;

means for selectively attaching a weight to the backside of the glove opposite a palm portion of the glove;

a thin layer of material along the palm side of the glove to facilitate gripping a soccer ball, the thin layer of material having an increased coefficient of friction for leather or other materials out of which soccer balls are made relative to materials out of which other parts of the glove are fashioned; and a rigid component in a finger portion to mitigate hyperextension.

2. The glove of claim 1, wherein the means for selectively attaching a weight to the backside of the glove comprises:

a pocket formed within the backside of the glove and adapted to selectively receive a weight.

3. The glove of claim 2, wherein the means for selectively attaching a weight to the backside of the glove further comprises:

securing means for selectively securing the weight within the pocket.

4. The glove of claim 3, wherein the means for selectively attaching a weight to the backside of the glove further comprises:

closing means for selectively closing the pocket.

5. The glove of claim 4, wherein at least one of the securing means and the closing means comprises at least one of VELCRO, a zipper, a snap and a button.

6. The glove of claim 2, wherein the weight is formed out of at least one of steel, iron, copper, lead, silicon, a ceramic material, and a magnetic material.

7. The glove of claim 2, wherein the weight is formed out of one or more malleable substances that conform to a goalie's hand.

8. The glove of claim 2, further comprising:

a plurality of pockets formed within the backside of the glove and adapted to selectively receive respective weight, the pockets oriented such that the weights are substantially parallel with metacarpal bones of a goalie's hand.

9. The glove of claim 2, wherein the weight is shrouded in a layer of rubber like material.

10. The glove of claim 2, wherein the weight includes indicia of a magnitude or mass of weight.

11. The glove of claim 2, wherein at least one finger portion does not completely cover a corresponding digit.

12. The glove of claim 2, wherein at least one finger portion is selectively removable from the glove.

13. The glove of claim 1, wherein the coefficient of friction is between about 0.5 and 1.5.

14. The glove of claim 1, wherein the rigid component is located in a backside of the finger portion.

15. The glove of claim 1, wherein at least one of the rigid component is curved to mimic a human hand at rest, thereby making the glove more comfortable and less tiring to wear, the rigid component has relief points to facilitate forward flexing but limited backward flexing, and the rigid component is formed out of metal or plastic.

16. A soccer goalie glove suitable for use during training in a weighted condition and during play in an un-weighted condition, the glove facilitating improvement in the strength, agility and quickness of a goalie training with the glove, the glove comprising;

a palm side;

a back side;

means for selectively attaching a weight to the backside of the glove opposite a palm portion of the glove; and a thin layer of material along the palm side of the glove to facilitate gripping a soccer ball, the thin layer of material having an increased coefficient of friction for leather or other materials out of which soccer balls are made relative to materials out of which other parts of the glove are fashioned, wherein the thin layer of material comprises foam like material and extends to cover a wrist portion of the palm side of the glove.

17. The glove of claim 16, further comprising:

a securing strap sized to selectively encircle a goalie's wrist and designed to be placed alternately in an glove-securing orientation or a glove-removal orientation, the strap not creating a discontinuity in the thin layer of material along the palm side of the glove.

18. A soccer goalie training glove also suitable for use during actual competition, the glove comprising:

a palm side;

a back side;

a pocket formed within the backside opposite a palm portion of the glove, a weight that can be selectively received within and removed from the pocket;

a fastener that facilitates maintaining the weight within the pocket; and a thin layer of material along the palm side of the glove to facilitate gripping a soccer ball, the thin layer of material having an increased coefficient of friction for leather or other materials out of which soccer balls are made relative to materials out of which other parts of the glove are fashioned, wherein the thin layer of material comprises foam like material and extends to cover a wrist portion of the palm side of the glove.

19. A soccer goalie glove suitable for use during training in a weighted condition and during play in an un-weighted condition, the glove facilitating improvement in the strength, agility and quickness of a goalie training with the glove, the glove comprising:

a palm side;

a back side;

a pocket formed within the backside opposite a palm portion of the glove, the pocket configured to selectively receive a weight;

securing means for securing the weight within the pocket;

closing means for closing the pocket;

a rigid component located in a backside of a finger portion to mitigate hyperextension;

a thin layer of material extending all along the palm side of the glove, including under a wrist and a finger portion of the glove, the thin layer of material having an increased coefficient of friction for leather or other like materials out of which soccer balls may be made relative to material out of which other parts of the glove are made to facilitate enhanced gripping of a soccer ball; and a wrist strap to assist in securing the glove to a goalie's hand, the wrist strap not creating a discontinuity in the thin layer of material.

* * * * *